US006340182B1

(12) United States Patent
Kaneda et al.

(10) Patent No.: US 6,340,182 B1
(45) Date of Patent: Jan. 22, 2002

(54) FASTENER FOR PACKAGING

(75) Inventors: Takashi Kaneda; Toru Takahashi, both of Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/599,801

(22) Filed: Jun. 22, 2000

(30) Foreign Application Priority Data

Jun. 24, 1999 (JP) ..... 11-178344

(51) Int. Cl.[7] ..... E05C 19/10; B65D 5/44

(52) U.S. Cl. ..... 292/102; 292/56; 292/203; 292/DIG. 38

(58) Field of Search ..... 292/56, 202, 203, 292/102, 198, 290, 292, 296, DIG. 38; 220/326, 693, 789, 835, FOR 101, FOR 197

(56) References Cited

FOREIGN PATENT DOCUMENTS

JP 19240 A * 1/1990
JP 9-203403 A * 8/1997
JP 11-20820 A * 1/1999

* cited by examiner

*Primary Examiner*—Robert J. Oberleitner
*Assistant Examiner*—Thomas Williams
(74) *Attorney, Agent, or Firm*—Frommer Lawrence & Haug LLP; William S. Frommer

(57) ABSTRACT

The present invention provides a fastener for packaging which has a relatively simple structure and yet can carry out a binding operation easily thus exhibiting a favorable usability. The fastener for packaging binds or connects a first plate body and a second plate body in the state that they are overlapped with their through holes aligned with each other. The fastener comprises a base body which is insertable into respective through holes, a first flange portion and a second flange portion which extend in the approximately horizontal direction from the base body, a moveable hook member having an approximately L shape, the moveable member is rotatably connected to a portion of the base body, and a lock means capable of locking and holding a state that the moveable hook member takes when the moveable hook member is rotated to a through hole mounting position by way of a hinge portion.

7 Claims, 7 Drawing Sheets

FASTENER FOR PACKAGING

BACKGROUND OF THE INVENTION

1. Field of the Invention

The present invention relates to a fastener for packaging which is particularly suitable for a packaging box which is made of cardboard or the like for packaging a product of a large weight.

2. Description of the Related Art

As a box for packaging the product of a large weight, there has been a box which can be divided into an upper box and a lower box for facilitating packaging as well as opening and closing of the box. Various kinds of fasteners for packaging which can connect these divided packaging boxes have been proposed in the past and one of such fasteners for packaging is disclosed in Japanese Patent Publication No. Hei 1-16743/1989.

In the structure of the fastener for packaging disclosed in the above-mentioned publication, the fastener for packaging is comprised of two members, that is, a cylindrical base body having a hook portion and a key body which is pushed into the inside of the base body so as to forcibly expand the hook portion. On the other hand, through holes are formed in portions of the upper and lower boxes to be connected which are overlapped with each other. In connecting the upper and lower boxes, an upper plate and a lower plate are overlapped with each other while aligning the positions of the through holes, and the base body of the fastener for packaging is inserted into the through holes, and subsequently, the key body of the fastener for packaging is inserted and pushed into the base body so as to forcibly expand the hook portion thus fixedly securing the fastener for packaging to the upper and lower boxes and accordingly connecting the upper and lower boxes with such a securing.

As described above, in the conventional fastener for packaging disclosed in the Japanese Patent Publication No. Hei 1-16743/1989, it is necessary to push the key body into the base body after inserting the base body into the through holes and hence, it is necessary to perform two manipulations. Accordingly, the operation is cumbersome. Further, the key body is pushed into the base body and is held in that state by such a pushing and so that the key body becomes relatively large. Accordingly, with the holding structure which simply pushes the key body into the base body, the key is liable to be easily removed by a local external force.

SUMMARY OF THE INVENTION

The present invention has been made under the above-mentioned background and it is an object of the present invention to provide a fastener for packaging which can solve the above-mentioned problems thoroughly, has a relatively simple structure, and can perform the connecting operation easily thus having a favorable usability. Further objects of the present invention become apparent in the description which is explained hereinafter in sequence.

To achieve the above-mentioned object, the present invention is directed to a fastener for packaging which connects a first plate body and a second plate body respectively having through holes in a state that the first plate body and the second plate body are overlapped in an up and down direction or a left and right direction with the through holes being aligned with each other and comprises a base body formed with a thickness which corresponds to the through holes and being insertable into respective through holes, a first flange portion and a second flange portion which extend in the approximately horizontal direction from one portions of upper and lower sides of an outer surface of the base body, the first flange portion and the second flange portions clamping the first and second plate bodies from front and rear surfaces in a state that the base body is completely inserted into both through holes, a movable hook member having an approximately L shape, the movable hook member rotatably connected to a portion of the base body in the vicinity of a lower end edge out of lower end edges of the base body which is disposed apart from the second flange portion by way of a hinge portion, the movable hook member being rotated from a through hole insertion initial position where a horizontal portion of the L shape is moved away from a corresponding side surface of the base body and is directed downwardly to a through hole mounting position where a vertical portion of the L shape is brought into contact with the corresponding side surface of the base body and the horizontal portion of the L shape is brought into contact with the rear surface of the second plate body as a third flange portion in the same manner as the second flange portion, and lock means provided to corresponding side surfaces of the movable hook member and the base body, the lock means capable of holding and locking a state which the movable hook member takes when the movable hook member is rotated to the through hole mounting position by way of the hinge portion.

Here, the first flange portion is mounted on the upper side of the outer surface of the base body. This mounting of the first flange portion on the upper side of the outer surface includes a mode in which the flange portion is formed by contiguously protruding from a portion of the upper side of the outer surface other than a portion which corresponds to the movable hook member and a mode in which flange portions are protruded from a plurality of portions of the upper side of the outer surface in a non-contiguous manner. On the other hand, the second flange portion is mounted on a portion of the lower side of the outer surface of the base body. In this case, it is important that the second flange portion is mounted apart from the movable hook member. Accordingly, the mounting of the second flange portion on the lower side of the outer surface of the base body is not limited to a mode in which the second flange portion is formed by protruding from a portion which faces the movable hook member in an opposed manner shown in FIG. 2. For example, by forming the through holes which allow protruding portions indicated by symbols X in FIG. 2 to pass therethrough in the first plate body and the second plate body, a mode in which the second flange portions are formed in a protruding manner at portions indicated by symbols X in FIG. 2, that is, portions which are positioned at both sides of the base body and apart from the movable hook members or a mode in which the second flange portions are in a protruding manner formed at the above-mentioned portions contiguously or non-contiguously may be adopted.

Due to the above-mentioned constitution, as illustrated in FIG. 9, with respect to both through holes of the first and second plate bodies, with the movable hook member held in a state of the initial position of the through hole insertion by way of the hinge portion where the horizontal portion of the L shape is directed downwardly and the vertical portion is directed approximately horizontally, when the base body has the lower-side second flange portion thereof passed through both through holes of the first and second plate bodies and moved to the rear surface side of the second plate body, the (downwardly directed) horizontal portion of the L-shape falls into the inside of the holes until the movement of the (approximately horizontally directed) vertical portion is restricted by being brought into contact with the surface side of the first plate body. Simultaneously, a portion of the first flange portion and the second flange portion sandwich the total thickness of the first and second plate bodies from front and back. From this state, for example, when the base body is pushed or pressed from an upper side which corresponds to the hinge portion, while the base body is pushed into both through holes shown in FIG. 10, due to a downward stress, the (approximately horizontally directed) vertical portion of the L-shape is rotated in the direction to come into contact with the corresponding side surface of the base body about the receiving hinge portion as a fulcrum and takes a normal vertical position and simultaneously the horizontal portion of the L-shape is rotatably moved from the downwardly directed state to the rear surface side of the second plate body, that is, to the horizontal state. Accordingly, the fastener of the present invention is bound to the first and second plate bodies which are overlapped with a given clamping force in the state that the first flange portion of the base body is positioned at the front surface side and the second flange portion and the horizontal portion of the L-shape which works as the third flange portion are positioned at the rear surface side. Further, this binding state is surely locked and held by the lock means provided between the base body and the movable hook member.

DESCRIPTION OF THE PREFERRED EMBODIMENTS

Embodiments of the present invention are explained in detail in conjunction with drawings. Although the embodiments are preferred specific examples of the present invention and technically desirable various limitations are made, the technical scope of the present invention is not restricted by these limitations.

Figure 12:
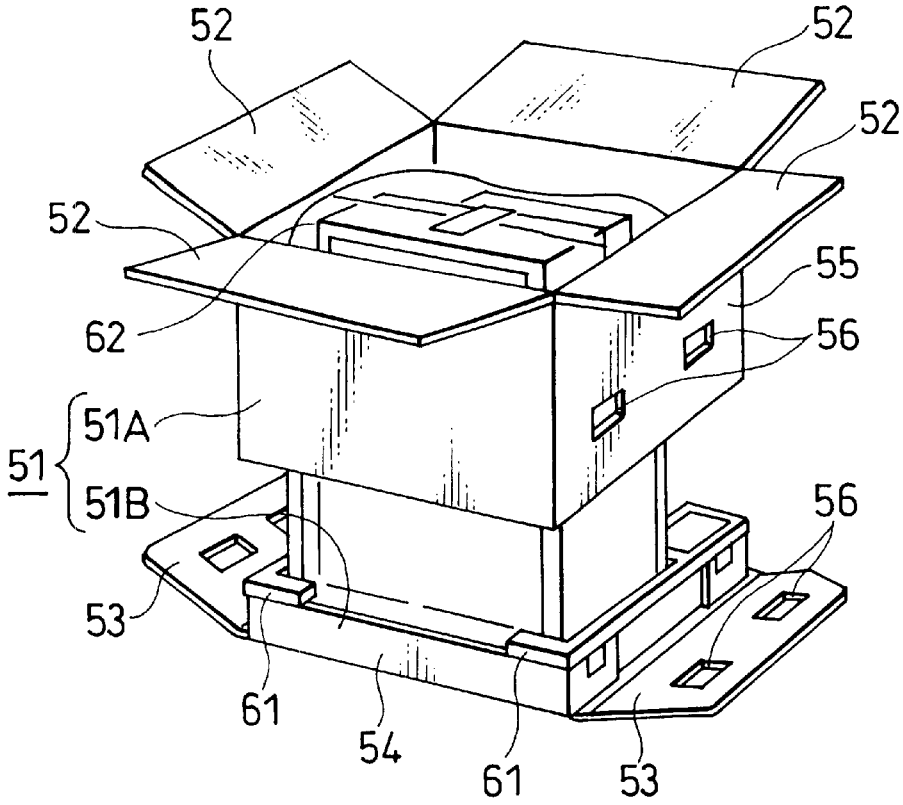
FIG. 12 is a perspective view showing one example of a packaging box to which the above-mentioned fastener for packaging is applied.
Figure 13:
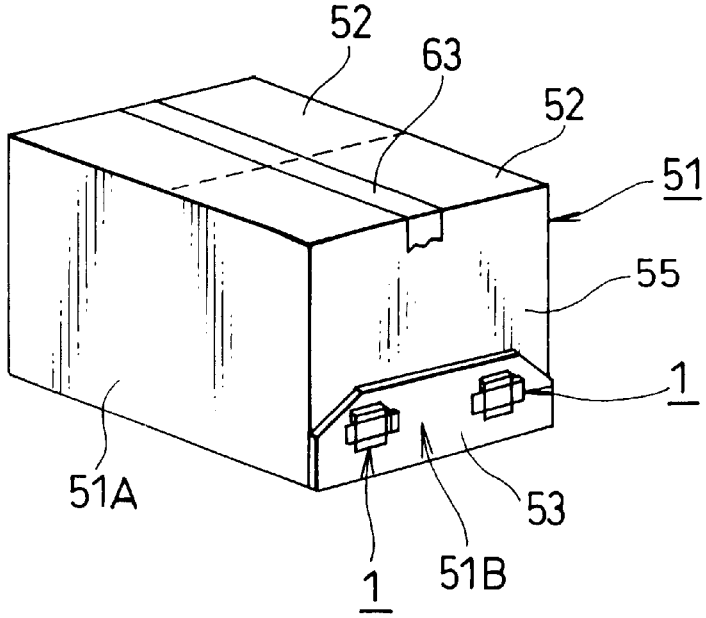
FIG. 13 is a perspective view showing one example of a packaging box to which the above-mentioned fastener for packaging is applied.

FIG. 12 and FIG. 13 are perspective views showing one example of a preferred packaging box for using the fastener for packaging of the present invention. First of all, the structure of the packaging box is explained in view of FIG. 12 and FIG. 13. The packaging box 51 is made of cardboard or the like and is comprised of an upper box 51A which forms a rectangular cylindrical drum portion and a lower box 51B which forms a bottom plate portion. In the state that flaps 52 of the upper box 51 and flaps 53 of the lower box 51B are opened, the upper box 51A is arranged from above such that side plates 54 of the lower box 51B are inserted into the inside of the upper box 51A. Then, the flaps 53 of the lower box 51B are lifted and are brought into contact with side plates 55 of the upper box 51A. A plurality of fasteners 1 for packaging of the present invention are mounted between the flaps 53 constituting first plate bodies and the side plates 55 constituting second plate bodies which are overlapped with each other. The lower box 51B and the upper box 51A are connected by these fasteners 1 so as to form a single packaging box 51. The positions where the fasteners 1 are mounted are determined in view of the weight of a product 62 accommodated in the packaging box 51, the shape of the packaging box 51 and the like. In this embodiment, the four fasteners 1 in total, that is, two fasteners 1 at left side and two fasteners 1 at right side are provided. In the flaps 53 and the side plates 55 on which the fasteners 1 for packaging of the present invention are mounted, through holes 56 respectively having a rectangular shape are formed at positions corresponding to each other. In the inside of the packaging box 51 assembled in the above-mentioned manner, before closing the flaps 52 which constitute an upper lid of the upper box 51A, buffer members 61 and the product 62 which is a heavy object are accommodated. After accommodating the product, the flaps 52 are closed and a further treatment such as the sealing with a tape 63 is applied. FIG. 13 shows the state of the packaging box 51 after packaging. The order of connecting or binding the upper box 51A and the lower box 51B by means of the fasteners 1 may come after the product 62 is accommodated in the lower box 51B and such an order can be arbitrarily determined depending on a product or the like to be packaged.

Figure 1:
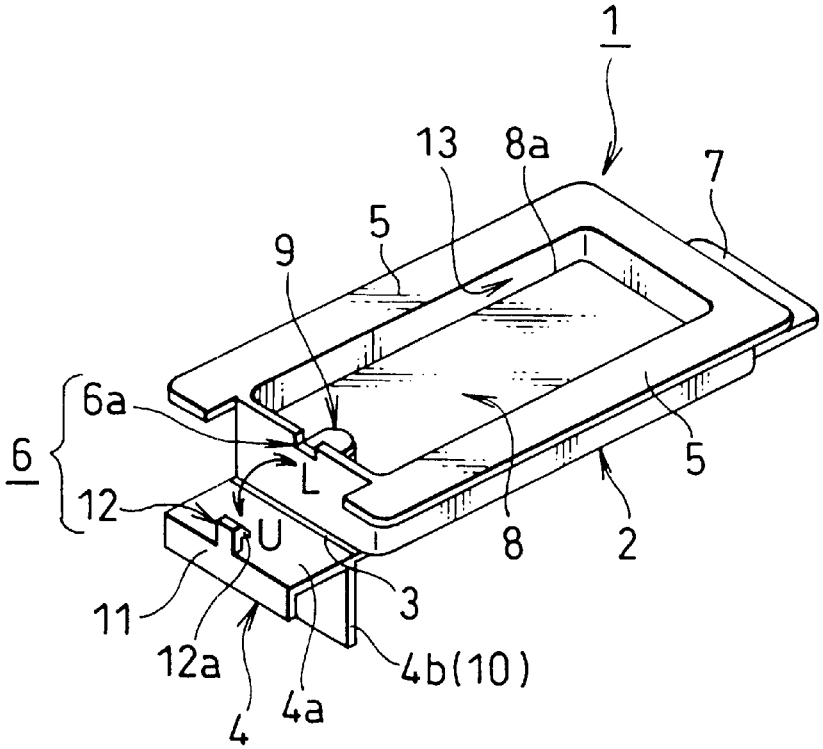
FIG. 1 is a schematic front perspective view of the fastener for packaging as an example of the embodiment of the present invention.
Figure 2:
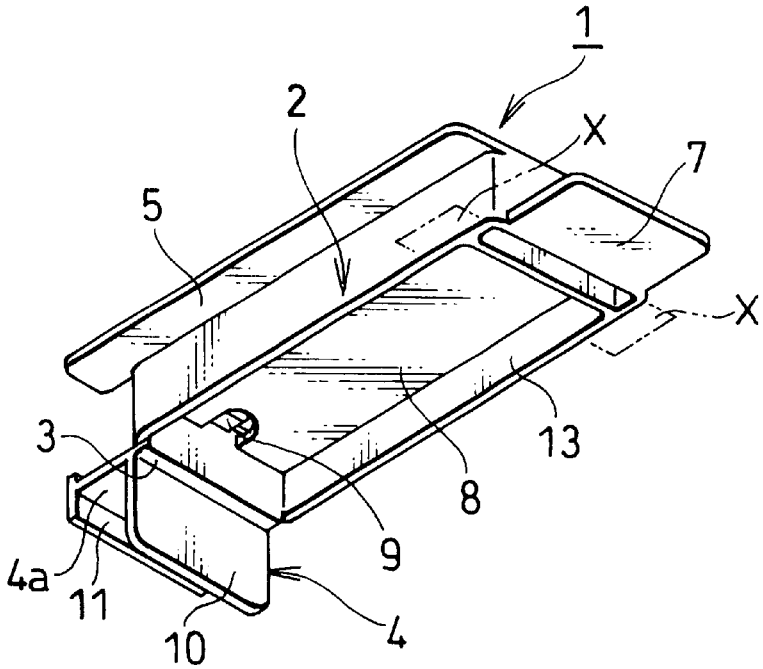
FIG. 2 is a perspective view of the fastener for packaging is of FIG. 1 as looked up from below.
Figure 3:
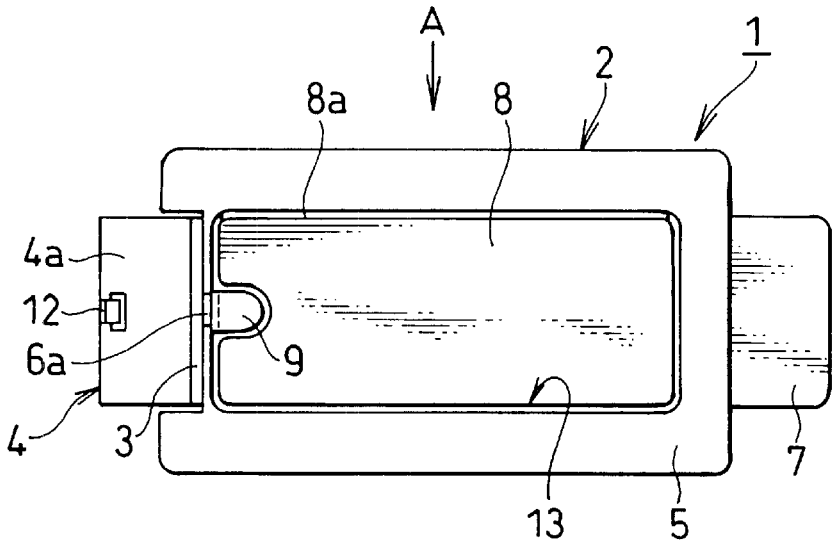
FIG. 3 is a front view of the fastener for packaging of FIG. 1.
Figure 4:
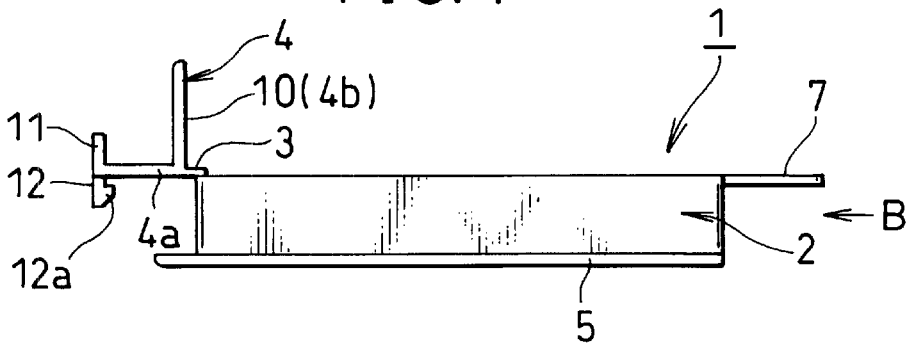
FIG. 4 is a side view of the fastener as seen from the direction of an arrow A in FIG. 3 after turning the fastener up side down.
Figure 5:
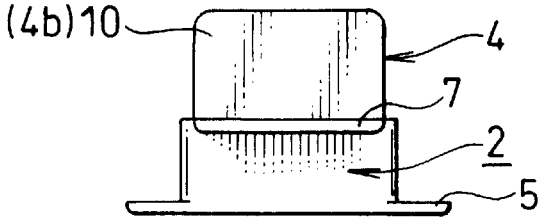
FIG. 5 is a side view of the fastener for packaging as seen from the direction of an arrow B in FIG. 4.
Figure 6:
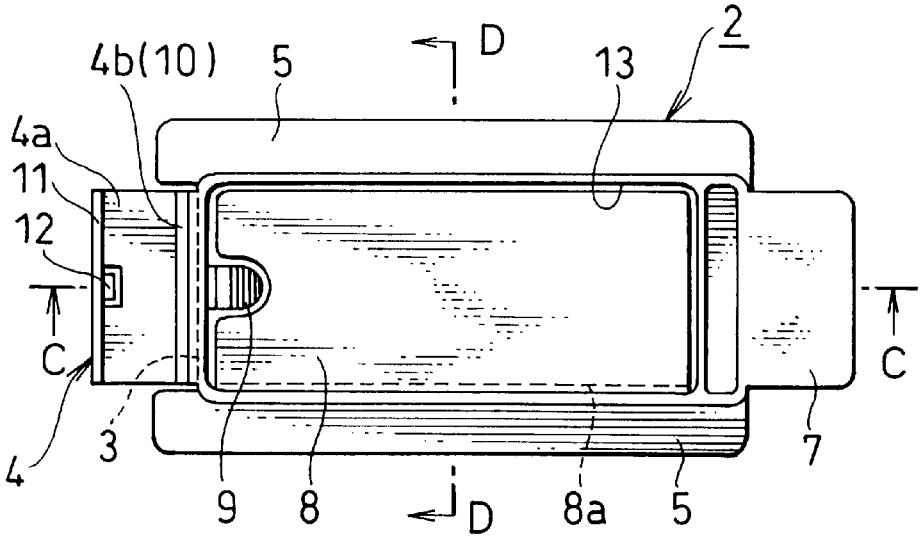
FIG. 6 is a bottom plan view of the fastener for packaging of FIG. 1.
Figure 7:
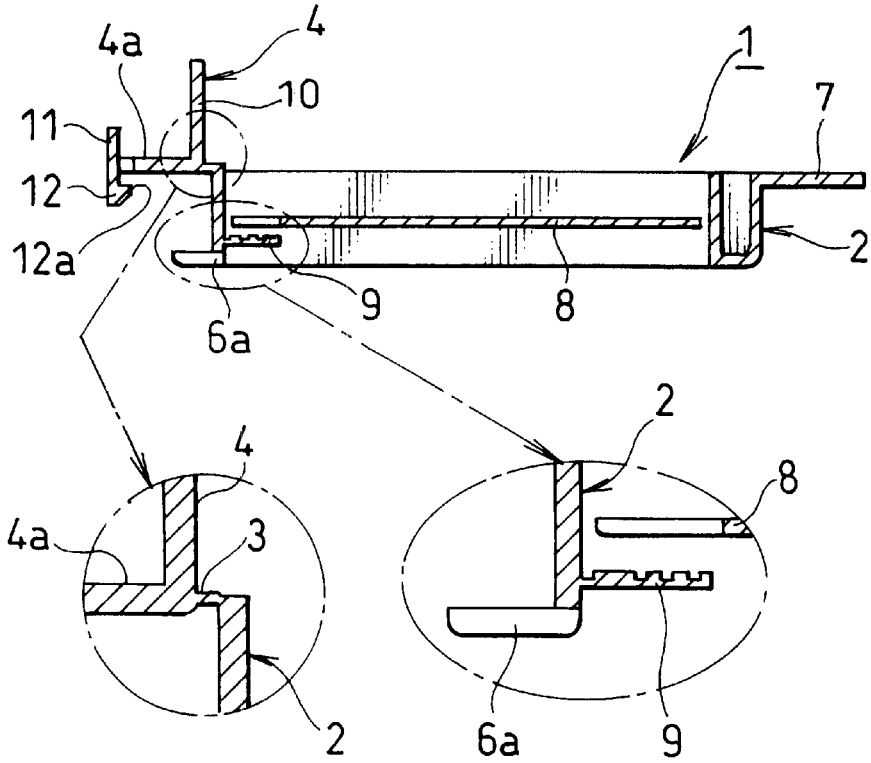
FIG. 7 is a longitudinal cross-sectional view as seen in an arrow direction from a line C—C in FIG. 6.
Figure 8:
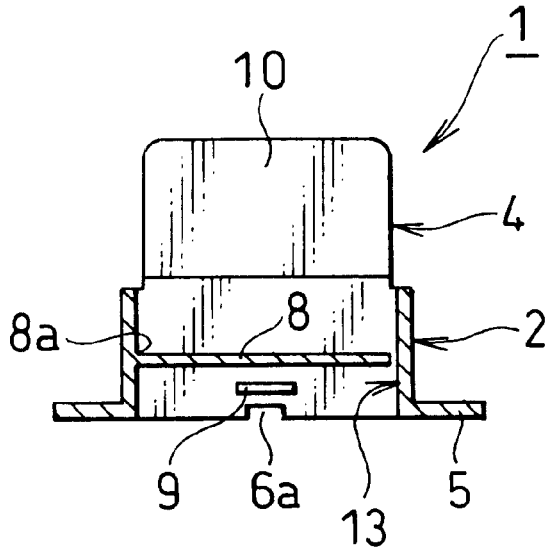
FIG. 8 is a longitudinal cross-sectional view as seen in an arrow direction from a line D—D in FIG. 6.
Figure 9:
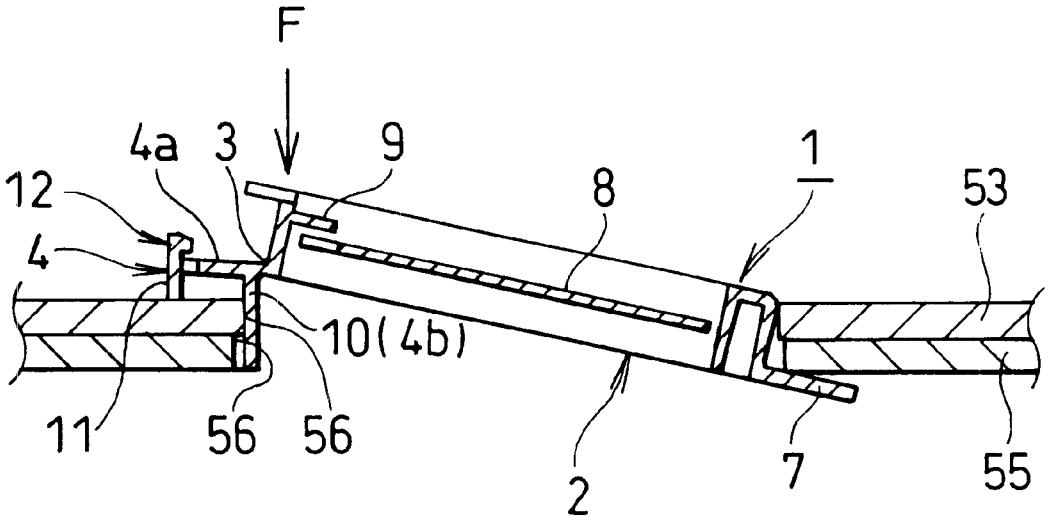
FIG. 9 is an operational view of the above-mentioned fastener for packaging.
Figure 10:
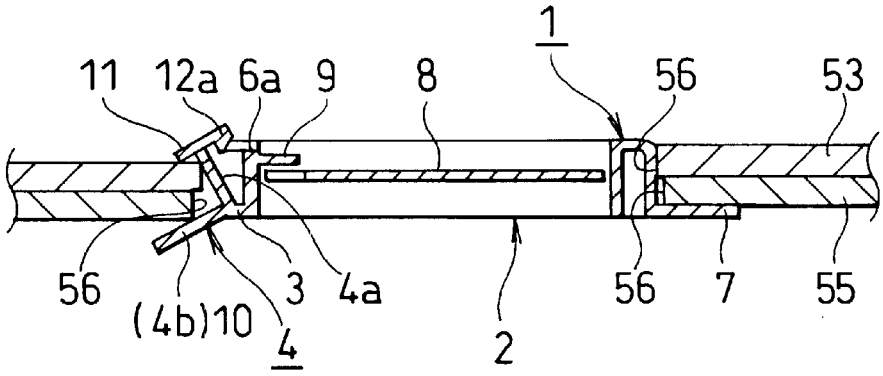
FIG. 10 is an operational view of the above-mentioned fastener for packaging.
Figure 11:
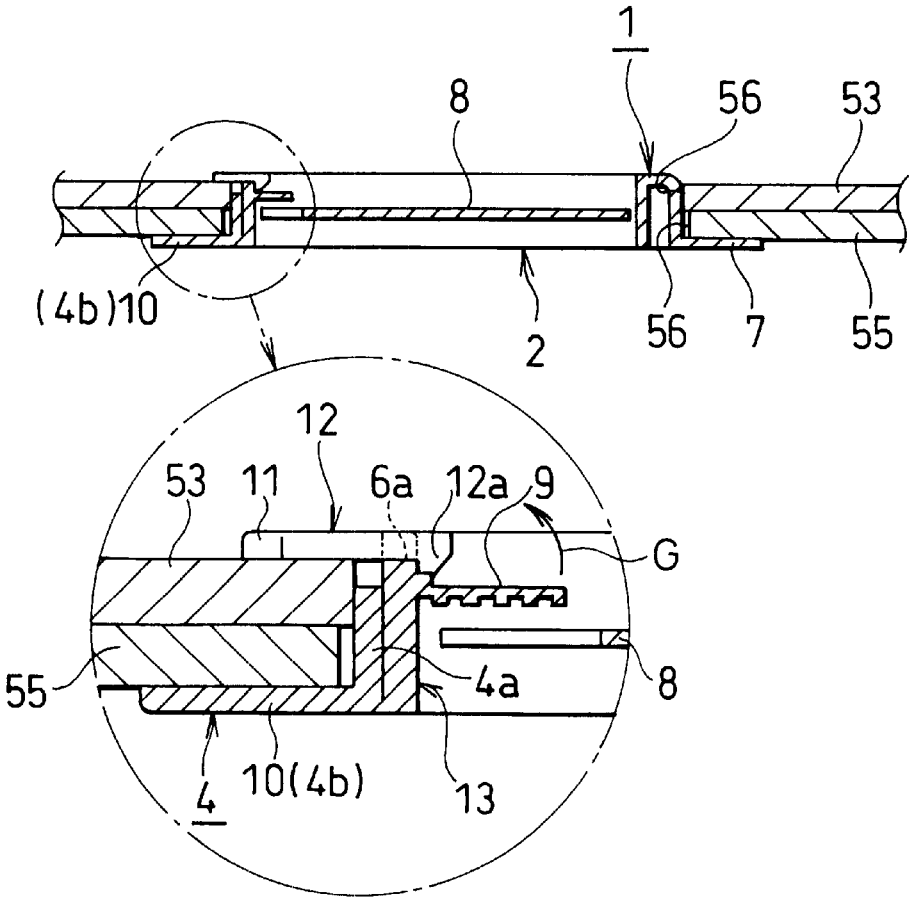
FIG. 11 is an operational view of the above-mentioned fastener for packaging.

Then, FIG. 1 to FIG. 8 show the fastener for packaging of one example of the present invention, wherein FIG. 1 is a schematic front perspective view of the fastener for packaging, FIG. 2 is a perspective view of the fastener as looked up from below, FIG. 3 is a front view of the fastener, FIG. 4 is a side view of the fastener as seen from the direction of an arrow A in FIG. 3 after turning the fastener up side down, FIG. 5 is a side view of the fastener as seen from the direction of an arrow B in FIG. 4, FIG. 6 is a bottom plan view of the fastener, FIG. 7 is a longitudinal cross-sectional view as seen in an arrow direction from a line C—C in FIG. 6, and FIG. 8 is a longitudinal cross-sectional view as seen in an arrow direction from a line D—D in FIG. 6. Further, FIG. 9 to FIG. 11 are operational views showing the method for mounting the fastener for packaging of the present invention.

Here, the constitution of the fastener 1 for packaging according to the present invention is explained in conjunction with FIG. 1 to FIG. 11 as a case where the fastener 1 is used for the packaging box 51 shown in FIG. 12 and FIG. 13. As shown in FIG. 1 to FIG. 11, the fastener 1 for packaging is formed of a single resin molded product and includes a base body 2 and a movable hook member 4 which is attached to the base body 2 by way of a hinge portion 3. As shown in detail in FIG. 7, the hinge portion 3 is formed by making the thickness of a portion between the base body 2 and the movable hook member 4 thin.

In such a constitution, the base body 2 is formed into a cylindrical body which has an opening 13 at a central portion thereof and has a rectangular cross section whose contour is slightly smaller than that of the through hole 56 of the packaging box 51. The thickness of the base body 2 in the front and back direction is determined such that the thickness substantially falls within the combined thickness of the flap 53 constituting the first plate body and the side plate 55 constituting the second plate body which are overlapped when the base body 2 is inserted into the through holes 56 as shown in FIG. 11. Except for one side at the front side or the upper side end of the base body 2, a first flange portion 5 is formed in a horizontally protruding manner on remaining three sides such that the first flange portion 5 extends outwardly from the peripheral surface at an approximately right angle. A lock receiving portion 6*a* which constitutes a part of the lock means 6 which will be explained later is formed as a notch on the one side where the first flange portion 5 is not formed. On the other hand, at the rear end or the lower side of the base body 2, the hinge portion 3 is formed on a side which faces the side in which the lock receiving portion 6*a* is formed in an opposed manner. Further, on a side of the base body 2 which faces the hinge portion 3 in an opposed manner, a second flange portion 7 is formed in a horizontally protruding manner such that the second flange portion 7 extends outwardly from the outer peripheral surface at an approximately right angle. A dust proof lid 8 and a release tab 9 are provided to the inside of the base body 2.

The dust proof lid 8 is formed in a thin plate shape which is large enough to substantially close the opening 13 of the base body 2. The dust proof lid 8 has a proximal portion 8*a* thereof tiltably connected to a longitudinal directional one side of the base body 2. The dustproof lid 8 usually closes the opening 13 of the base body 2. When an operator inserts his hand into the opening 13 at the time of carrying the packaging box 51 which accommodates the product 62, the dustproof lid 8 is collapsed due to its resilient deformation with the connecting proximal end 8*a* at the one side of the base body 2 as a fulcrum. In this manner, the operator can insert his hand in the opening 13 of the base body 2 and can use the dustproof lid 8 as a pull. Further, when the operator pulls out his hand from the opening 13, the dustproof lid 8 returns to the original position resiliently and again functions as a lid so as to prevent the intrusion of dust or the like. There release tab 9 is formed corresponding to a portion where the lock receiving portion 6*a* is formed. To describe the shape, the release tab 9 is formed in a tongue shape which the operator can pinch and pull the release tab 9 in the direction of an arrow G shown in FIG. 11. That is, when the operator pinches the release tab 9 with his fingers and pulls the release tab 9 in the direction of the arrow G shown in FIG. 11, a proximal end of the release tab 9 pushes up a distal end pawl 12*a* of a lock member 12 which is latched to the lock receiving portion 6*a* which will be explained later and hence, the lock member 12 can be released.

The movable hook member 4 is formed in an approximately L shape and is comprised of a vertical portion 4*a* and a horizontal portion 4*b* which constitutes a third flange portion 10 as main components thereof. The movable hook member 4 includes a relatively small fourth flange portion 11 which is disposed at a distal end of the vertical portion 4*a* and is formed in a protruding manner approximately parallel to the horizontal portion 4*b* and the lock member 12 having the distal end pawl 12*a* which is protruded from a base body 2 side surface of the vertical portion 4*a* at the distal end side intermediate portion and constitutes the lock means 6. Further, in this movable hook member 4, a border portion (a corner portion) between the vertical portion 4*a* and the horizontal portion 4*b* is connected to the edge portion of one side disposed at the lower end side of the base body 2 by way of the hinge portion 3. Further, when the vertical portion 4*a* is rotated in the direction of an arrow L in FIG. 1, the vertical portion 4*a* comes into contact with the corresponding outer peripheral surface of the base body 2. Then, as shown in FIG. 11, the lock member 12 is positioned in the inside of the base body 2 through the lock receiving portion 6*a* and the distal end pawl 12*a* is engaged with the corresponding edge of the lock receiving portion 6*a* so that the engaged state is locked and held. On the other hand, the horizontal portion 4*b* which constitutes the third flange portion 10 and the fourth flange portion 11 of the movable hook member 4 are used to sandwich or clamp the overlapped side plate 55 and the flap 53 from both sides.

In the state that the movable hook member 4 is brought into contact with the corresponding side surface of the base body 2, that is, in the state that the movable hook member 4 is rotated to a through hole mounting position, the fourth flange portion 11 is set in the state where the fourth flange portion 11 becomes contiguous with the first flange portion 5. Accordingly, the fourth flange portion 11 has a function of preventing the removal of the base body 2 in the same manner as the first flange portion 5. Simultaneously, since the contiguous flange shape can be obtained, the outer appearance of the fastener 1 is enhanced. In addition, when the movable hook member 4 is rotatably manipulated from the through hole insertion initial position shown in FIG. 9 to the through hole mounting position shown in FIG. 11, the fourth flange portion 11 is effectively used as a point of force. That is, in the manipulation for rotating the movable hook member 4 from the through hole insertion initial position to the through hole mounting position by way of the hinge portion 3 which works as the fulcrum, the fourth flange portion 11 is disposed at a position apart from the hinge portion 3 (having a significance that the distance between the hinge portion 3 and the point of force or the manipulating portion can be more separated) and the fourth flange portion 11 can be grasped more easily so that the movable hook portion 4 can be rotated more easily.

Figure 14A:
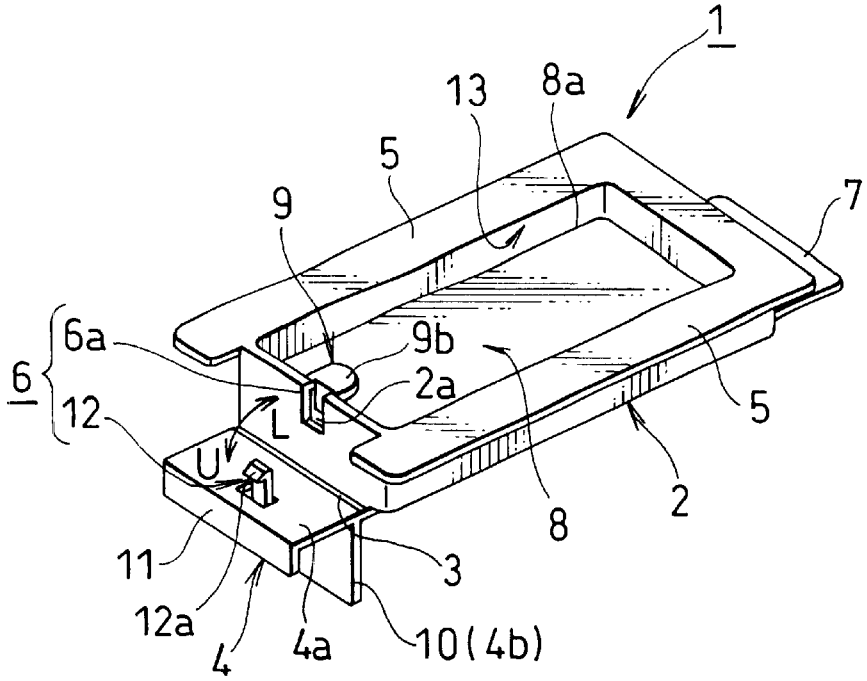
FIG. 14A and FIG. 14B are views showing a modification of lock means of the above-mentioned fastener for packaging.
Figure 14B:
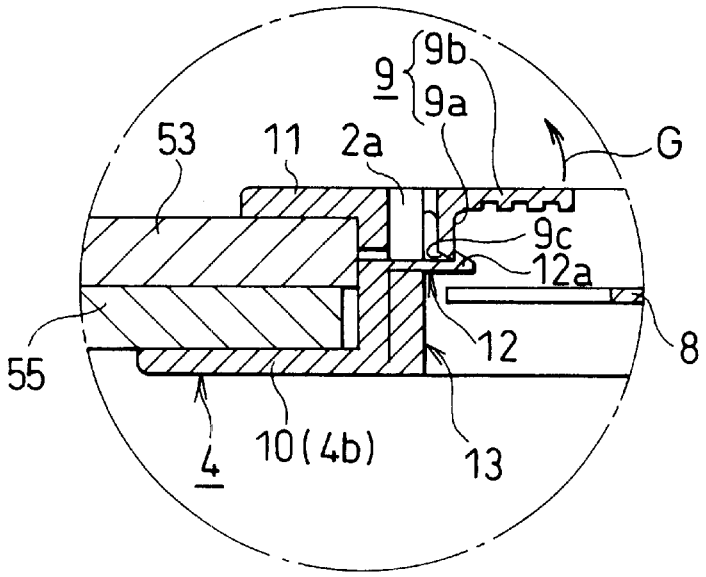

Further, the lock means 6 is not limited to such an embodiment and may be modified in various forms corresponding to the sizes and the shapes of the base body 2 and the movable hook member 4, the mass production mode of the fasteners 1 and the like. FIG. 14A and FIG. 14B show such an example. FIG. 14A corresponds to FIG. 1 and FIG. 14B corresponds to an enlarged view in FIG. 11. In the explanation hereunder, members and portions which are explained above are given same symbols and only points which are altered are explained. The lock means 6 is comprised of a lock member 12 at a movable hook member 4 side and a release tab 9 at a base body 2 side. The lock member 12 differs from the previously mentioned lock member 12 in that the lock member 12 is provided to a surface of a vertical portion 4*a* disposed at the base body 2 side and is protruded from the vertical portion 4*a* at an intermediate portion thereof disposed slightly below a distal end thereof, and a distal end pawl 12*a* is protruded upwardly. The release tab 9 differs from the previously mentioned release tab 9 in that the release tab 9 is provided to a side surface of the base body 2 which corresponds to the movable hook member 4 and is formed on the inner surface of the base body 2 in an approximately inverted L shape directed downwardly. With respect to this release tab 9, a border portion (a corner portion) between an vertical portion 9*a* and an horizontal portion 9*b* of the inverted L-shape is tiltably connected to a corresponding upper end edge side of the base body 2, wherein the horizontal portion 9*b* of the inverted L-shape constitutes a tab portion and the vertical portion 9*a* of the inverted L-shape is provided with an engaging pawl 9*c* at a distal end thereof. In the course of rotating the movable hook member 4 to the through hole mounting position, the lock member 12 is moved into the inside of the base body 2 through an opening 2*a* formed in a corresponding portion of the base body 2 and the distal end pawl 12*a* resiliently gets over the engaging pawl 9*c* of the vertical portion 9*a* so that movable hook member 4 is held in a locking state. This locking holding state is released such that when the operator pinches the horizontal portion 9*b* with his finger and then rotates the release tab 9 in a direction of an arrow G, the engaging pawl 9*c* is disengaged from the distal end pawl 12*a* thus releasing the engagement.

Subsequently, the manner of operation for connecting or binding the lower box 51B and the upper box 51A by using the fastener 1 for packaging having the above-mentioned constitution is explained in sequence in conjunction with FIG. 9 to FIG. 11.

First of all, the flaps 53 are overlapped onto the side plates 55 while aligning the positions of the through holes 56 with each other. Subsequently, in the state that the engagement between the lock member 12 and the lock receiving portion 6*a* is disengaged, the movable hook member 4 is bent in the direction of an arrow U shown in FIG. 1 about the hinge portion 3 relative to the base body 2 such that an angle made by the base body 2 and the horizontal portion 4*b* becomes equal to or less than 90°. In this state, the second flange portion 7 is obliquely inserted into the inside of the through holes 56 from the flap 53 side and, at the same time, the third flange portion 10 of the movable hook member 4 is straightly inserted into the inside of the through holes 56 such that the second flange portion 7 is protruded from the rear surface side of the side plate 55 and the distal end of the third flange portion 10 is slightly protruded from the rear surface side of the side plate 55. FIG. 9 shows such a state. Subsequently, the operator strongly pushes one end side of the base body 2 with his finger in the direction of an arrow F shown in FIG. 9. Then, as shown in FIG. 10, the base body 2 and the movable hook member 4 are inserted into the through holes 56 while the movable hook member 4 and the base body 2 are rotated in opposite directions from each other. Further, when the base body 2 and the movable hook member 4 are pushed into the final position, the base body 2 and the movable hook member 4 are juxtaposed on the same plane in the through holes 56 and, as shown in FIG. 11, the distal end pawl 12*a* of the lock member 12 is engaged with the lock receiving portion 6*a* and this state is locked. At this final ring position, the second flange portion 7 and the third flange portion 10 are respectively brought into contact with the rear surface of the side plate 55 and the first flange portion 5 and the fourth flange portion 11 are brought into contact with the front surface of the flap 53. That is, the side plate 55 and the flap 53 which are overlapped with each other are clamped from both sides with the use of the second flange portion 7 and the third flange portion 10 as well as the first flange portion 5 and the fourth flange portion 11 thus mounting the fastener 1 for packaging. By carrying out this mounting operation of the fastener 1 for packaging with respect to the left and right through holes 56 respectively, the upper box 51A and the lower box 51B are bound with each other to form the integral packaging box 51. In removing the fasteners 1 for packaging which are once mounted, when the operator rotates the release tab 9 in the direction of the arrow G shown in FIG. 11, the distal end pawl 12*a* is disengaged from the lock receiving portion 6*a* and the fastener 1 for packaging can be removed with the manipulation of opposite sequence, that is, the pulling-out operation.

In this manner, according to the constitution of the above-mentioned fastener 1, the movable hook member 4 is bent until the angle made by the base body 2 and the horizontal portion 4 becomes equal to or less than 90° by using the hinge portion 3 as a fulcrum, then, the base body 2 and the movable hook member 4 are inserted into the through holes 56 from the first plate body (flap 53) side until the second flange portion 7 of the base body 2 and the third flange portion 10 of the movable hook member 4 pass through the through holes 56 to the rear surface side of the second plate body (side plate 55), and when the hinge portion 3 is pushed into the through holes 56 in such a state that the base body 2 and the movable hook member 4 are pushed into the through holes 56 while the base body 2 and the movable hook member 4 are rotated in opposite directions from each other, and at the final position, that is, at the through hole mounting position, the second flange portion 7 and the third flange portion 10 are brought into contact with the rear surface side of the second plate body (side plate 55) and the first flange portion 5 and the fourth flange portion 11 are brought into contact with the surface side of the first plate body (flap 53) so that the first and second plate bodies are clamped respectively from both sides by means of the first flange portion 5 and the fourth flange portion 11 as well as by means of the second flange portion 7 and the third flange portion 10 which face the first flange portion 5 and the fourth flange portion 11 in an opposed manner, whereby the first and second plate bodies can be bound substantially at a touch. Further, this binding state is surely locked and held by the lock means 6 provided between the base body 2 and the movable hook member 4. Further, since the base body 2 is formed in a cylindrical shape such that a hand can be inserted therein, the base body 2 can be used as a pull. In case the hand is not inserted, since the dustproof lid 8 which closes the inside hole of the base body 2 is provided, the intrusion of dust into the inside of the packaging box 51 through the hole of the base body 2 can be prevented.

What is claimed is:

1. A fastener for packaging which connects a first plate body and a second plate body respectively having through holes in a state that said first plate body and said second plate body are overlapped in an up and down direction or a left and right direction with said through holes being aligned with each other comprising:

a base body formed with a thickness which corresponds to said through holes and being insertable into respective through holes, a first flange portion and a second flange portion which extend in the approximately horizontal direction from one portions of upper and lower sides of an outer surface of said base body, said first flange portion and said second flange portion clamping said first and second plate bodies from front and rear surfaces in a state that said base body is completely inserted into said both through holes, a movable hook member having an approximately L shape, said movable hook member rotatably connected to a portion of said base body in the vicinity of a lower end edge out of lower end edges of said base body which is disposed apart from said second flange portion by way of a hinge portion, said movable hook member being rotated from a through hole insertion initial position where a horizontal portion of said L shape is moved away from a corresponding side surface of said base body and is directed downwardly to a through hole mounting position where a vertical portion of said L shape is brought into contact with said corresponding side surface of said base body and said horizontal portion of said L shape is brought into contact with a rear surface of said second plate body as a third flange portion in the same manner as said second flange portion, and lock means provided to corresponding surfaces of said movable hook member and said base body, said lock means capable of locking and holding a state which said movable hook member takes when said movable hook member is rotated to said through hole mounting position by way of said hinge portion.

2. A fastener for packaging according to claim 1, wherein said second flange portion is inserted in said both through holes, said movable hook portion is inserted in said through holes until said L shape reaches said insertion initial position, and said movable hook side of said base body is pushed in an inserting direction so as to connect said first plate body and said second plate body.

3. A fastener for packaging according to claim 2, wherein said first plate body constitutes a lower box of a packaging box and said second plate body constitutes an upper box of said packaging box.

4. A fastener for packaging according to claim 3, wherein said packaging box is a packaging box which is made of a cardboard which is capable of packaging a product having a large weight.

5. A fastener for packaging according to claim 1, wherein said fastener is integrally formed by resin molding, said base body is formed in a shape of a cylinder, said fastener includes a dustproof lid tiltably arranged in said cylinder, and said dustproof lid is provided tiltably in a depth direction of said base body to be used as a pull.

6. A fastener for packaging according to claim 2, wherein said lock means includes a lock member provided with a distal end pawl which is protruded from said vertical portion of said L shape of said movable hook member and a lock receiving portion which is provided to a corresponding side surface of said base body so as to be detachably engaged with said distal end pawl.

7. A fastener for packaging according to claim 3, wherein said lock receiving portion includes a release tab which is tiltably mounted on an inner side of said base body which corresponds to said lock member, and said distal end pawl of said lock member is latched to a portion of said release tab.

* * * * *